United States Patent [19]

Lawrence

[11] Patent Number: 4,735,391

[45] Date of Patent: Apr. 5, 1988

[54] SHELF SUPPORT

[75] Inventor: Barry G. Lawrence, Thomasville, N.C.

[73] Assignee: Lawrence Industries, Inc., Thomasville, N.C.

[21] Appl. No.: 936,732

[22] Filed: Nov. 28, 1986

[51] Int. Cl.[4] ..... A47G 29/02

[52] U.S. Cl. ..... 248/243; 211/90; 248/205.5; 248/235; 248/239

[58] Field of Search ..... 248/243, 239, 241, 242, 248/244, 245, 246, 205.5, 206.2, 206.3, 235, 903; 211/90

[56] References Cited

U.S. PATENT DOCUMENTS

| | | | |
|---|---|---|---|
| 1,183,212 | 5/1916 | Lenzikow et al. | 248/205.5 |
| 3,256,344 | 8/1966 | Ornstein | 248/243 |
| 3,544,053 | 12/1970 | Ingalls | 248/903 X |
| 3,570,793 | 3/1971 | Squibb | 248/243 X |
| 3,759,191 | 9/1973 | Freeman | 248/243 X |
| 4,376,521 | 3/1983 | Walters | 248/206.3 |
| 4,456,210 | 6/1984 | McBride | 248/205.5 |

*Primary Examiner*—Ramon O. Ramirez

[57] ABSTRACT

A shelf support is presented having a bracket with a base section including an opening for releasably securing a suction member. The suction member is formed from polyvinyl chloride and provides cushioning and gripping for a typical glass shelf.

5 Claims, 1 Drawing Sheet

SHELF SUPPORT

BACKGROUND OF THE INVENTION 1. Field of the Invention

The present invention relates to a shelf support and specifically a bracket of the type used with adjustable shelves in fine furniture such as china cabinets.

2. Description of the Prior Art And Objectives Of The Invention

Adjustable shelves have become increasing popular in recent years utilizing supports or brackets formed from metal, plastics and wood. Brackets used with glass shelves such as in china cabinets and other fine furniture have used rubber or vinyl coated metal and certain plastics to provide a somewhat resilient surface as support for the glass shelf. Purchasers of expensive or fine furniture are somewhat apprehensive to spend thousands of dollars on a particular furniture piece when it utilizes an unattractive plastic or other shelf support which detracts from the overall quality of the piece. It has also been desirable to maintain a shelf with a support which will both carry the shelf when weight is placed thereon and which will prevent "chattering" when the cabinet is moved from one location to another after assembly, as occurs when "hard" shelf supports such as made only of metal or dense plastic.

With the shortcomings and disadvantages known of conventional shelf supports, the present invention was conceived and one of its objectives is to provide a shelf support which is relatively small in size yet capable of supporting a fully loaded shelf.

It is another objective of the present invention to provide a shelf support which may be of the L-shaped bracket type (although other shapes may be used) for adjustability and which includes a suction member for gripping and cushioning the shelf.

It is still another objective of the present invention to provide a bracket with which various types and sizes of suction members can be utilized, depending on the particular characteristics desired.

Various other objectives and advantages of the present invention will become apparent to those skilled in the art as a more detailed explanation is set forth below.

SUMMARY OF THE INVENTION

The present invention comprises a shelf support for use with adjustable shelves in furniture cabinets or the like comprising an a bracket with a dowel affixed thereto. The dowel can be placed in one or more vertically aligned holes along the inside walls of the cabinet at the desired height. The base section of the bracket includes suction member securing means consisting of an opening in which a releasably positionable suction member is placed which will maintain a cushion between the shelf and the bracket base and which will grip the shelf to maintain it in position.

DESCRIPTION OF THE PREFERRED EMBODIMENT

Figure 2:
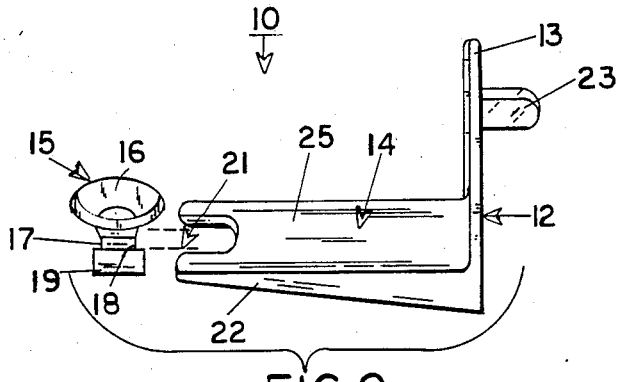
FIG. 2 shows in perspective fashion the shelf support with the suction member removed therefrom.

The preferred form of the invention as shown in FIG. 2 includes a metal L-shaped bracket having a dowel affixed thereto to the back of the upright section and includes a base section with a channel therein for receiving a suction member. The base section of the bracket has a pair of triangularly shaped stiffening members which extend from the front edge to the rear, underneath on opposite sides. The suction member is releasably secured within the U-shaped channel and includes a bowl, a neck and shoulders and is formed from a resilient material such as polyvinyl chloride which is plasticized to a desired hardness so as to be relatively flexible to provide suction to maintain a glass shelf in place and to cushion the shelf.

DETAILED DESCRIPTION OF THE DRAWINGS

Figure 1:
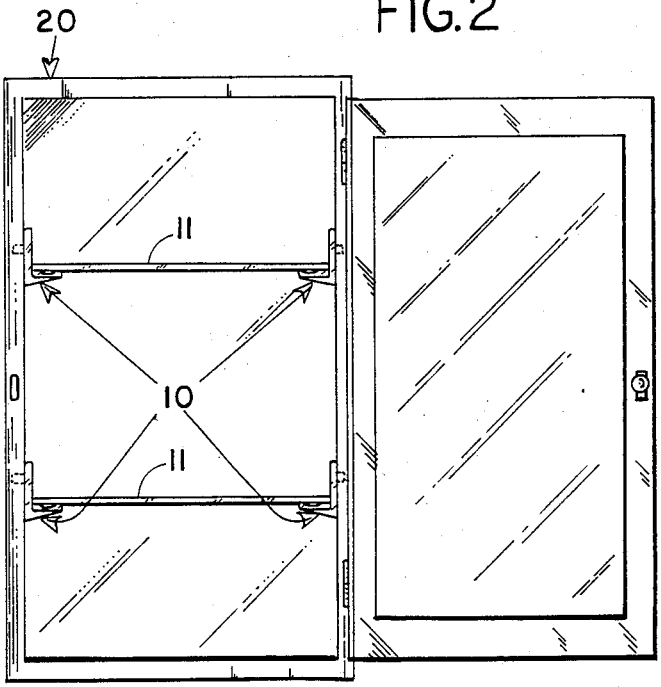
FIG. 1 demonstrates in fragmented fashion a section of a china cabinet with the shelf support of the present invention employed therein.
Figure 3:
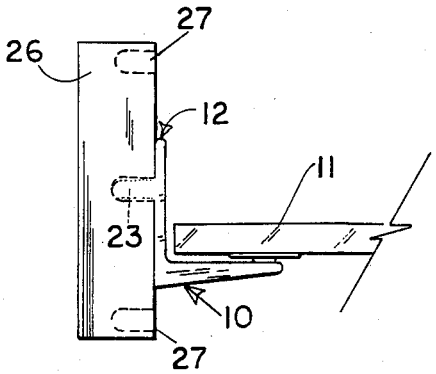
FIG. 3 demonstrates a side elevational view of a cabinet wall section with the shelf support of FIG. 2.
Figure 4:
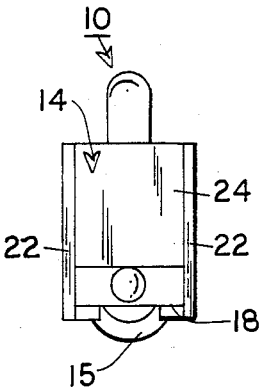
FIG. 4 shows a bottom plan view of the shelf support with the suction member in place.

Turning now to the drawings, in FIG. 1 china cabinet 20 is shown with shelf supports 10 engaging glass shelves 11. As understood, all shelf supports 10 are identical and as shown in FIG. 3 dowel 23 is positionable in cabinet wall 26 via wells 27 depending on the exact height desired. Shelf support 10 consists of two (2) main parts, bracket 12 which is shown as L-shaped (although other shapes may be used) as shown in FIG. 2 and suction member 15. Suction member 15 is releasably secured within bracket opening or channel 21 which is U-shaped and sized to accept neck 17 of suction member 15. Suction member 15 may be molded for example from a flexible, relatively light density polyvinyl chloride composition so bowl 16 is sufficiently flexible to "grip" glass shelf 11 as seen in FIG. 3. Shoulders 18 as further seen in FIG. 2 are relatively stiff and fit between stiffening members 22 along each side of base section bottom surface 24 as seen in FIG. 4. Stiffening members 22 are substantially triangularly shaped and provide rigidity to base section 14 in addition to preventing rotation of suction member 15. In addition to the suction grip provided by suction member 15 to shelf 11, suction member 15 provides resiliency and a cushion effect which prevents shelf 11 from "chattering" as it is moved since it is held in place and will not touch L-shape bracket 12. Suction member 15 can be removed from bracket 12 and can be replaced with a suction member, having greater or lesser resiliency, size or density as required. Suction member 15 has a base 19 which has a rectangular cross-section and is relatively rigid due to its thickness when compared with bowl portion 16 which is much thinner. The upper surface of suction member base 19 form shoulders on each side of neck 17 as seen in FIG. 2. Therefore, when suction member 15 is engaged in bracket channel 21 shoulders 18 are in contact with lower surface 24 of L-shaped bracket 12 and the underneath surface of bowl portion 16 contact base section upper surface 25.

In use, with opposing brackets 10' positioned at the required height, glass shelf 11 of suitable dimensions is positioned thereon. The weight of shelf 11 is sufficient to "flatten" bowl portion 16 allowing bowl portion 16 to grip shelf 11 and to form a suction contact with it whereby casual movement of the cabinet will not destroy the suction engagement between shelf 11 and suction member 15.

Various modifications and changes can be made to the shelf support as depicted herein and the illustrations and examples are presented only for illustrative purposes and are not intended to limit the scope of the appended claims.

I claim:

1. A shelf support comprising: an L-shaped bracket for supporting a horizontal shelf, said bracket having an upright section and a base section, a dowel, said dowel attached to said upright section for positioning said bracket against a cabinet side wall, said base section defining a channel, a suction member, said suction member including a bowl portion, a neck, said neck joined to said bowl portion, said neck being releasably received within said channel with said bowl portion upright for engagement with the underside of a shelf for supporting the same horizontally.

2. A shelf support as claimed in claim 1 wherein said L-shaped bracket is formed from metal.

3. A shelf support as claimed in claim 1 wherein said suction member is formed from polyvinyl chloride.

4. A shelf support as claimed in claim 1 wherein said channel is substantially U-shaped.

5. A shelf support as claimed in claim 1 wherein said suction member includes a base, said base having a pair of shoulders, and said bracket having a pair of stiffening members, said stiffening members affixed to the underside of said base section whereby said shoulders fit between said stiffening members to secure said suction member in said channel.

* * * * *